US006550991B2

(12) United States Patent
Michel et al.

(10) Patent No.: US 6,550,991 B2
(45) Date of Patent: Apr. 22, 2003

(54) PAPER TRAY ADJUSTMENT PAGE

(75) Inventors: Paul Michel, Redwood City, CA (US); Bradley Pirman, Pacifica, CA (US)

(73) Assignee: Electronics for Imaging, Inc., Foster City, CA (US)

( * ) Notice: Subject to any disclaimer, the term of this patent is extended or adjusted under 35 U.S.C. 154(b) by 7 days.

(21) Appl. No.: 09/814,455

(22) Filed: Mar. 22, 2001

(65) Prior Publication Data

US 2002/0136579 A1 Sep. 26, 2002

(51) Int. Cl.[7] ..... B41J 11/44

(52) U.S. Cl. ..... 400/70; 399/16; 400/582; 400/583.3

(58) Field of Search ..... 400/70, 76, 61, 400/578, 582, 279, 583.3; 399/16

(56) References Cited

U.S. PATENT DOCUMENTS

| | | | | |
|---|---|---|---|---|
| 4,610,445 A | | 9/1986 | Schneider et al. | 271/160 |
| 4,662,765 A | | 5/1987 | Kapp et al. | 400/595 |
| 4,831,420 A | * | 5/1989 | Walsh et al. | 271/226 |
| 5,046,714 A | | 9/1991 | Hwang | 271/162 |
| 5,091,654 A | * | 2/1992 | Coy et al. | 250/559.29 |
| 5,120,040 A | | 6/1992 | Worley | 271/9 |
| 5,277,418 A | | 1/1994 | Jones et al. | 271/164 |
| 5,379,101 A | | 1/1995 | Takahashi et al. | 355/309 |
| 5,391,009 A | | 2/1995 | Stodder | 400/605 |
| 5,532,847 A | | 7/1996 | Maruyama | 358/498 |
| 5,775,684 A | | 7/1998 | Jackson et al. | 271/9.07 |
| 5,813,771 A | | 12/1998 | Ur et al. | |
| 6,118,950 A | * | 9/2000 | Wibbels et al. | 399/16 |
| 6,367,996 B1 | * | 4/2002 | Edwards | 400/279 |

FOREIGN PATENT DOCUMENTS

| | | | |
|---|---|---|---|
| EP | 0728689 A2 | 8/1996 | 3/52 |
| EP | 0592116 B1 | 11/1996 | 1/4 |
| EP | 0911700 A2 | 4/1999 | |
| JP | 08088713 | 4/1996 | |

OTHER PUBLICATIONS

*HP Makes an Even Better Impression*; BYTE, vol. 23, No. 2, p. 129, Feb. 1998.
*Lasting Impression*; PC User, No. 211, p. 71, May 19–Jun. 1, 1993.
*Lasers on Stun*; PC User, May 20–Jun. 2, 1992.
*Automatic Duplex Copier*; IBM Technical Disclosure Bulletin, vol. 22, No. 4, p. 1379–1381.

* cited by examiner

*Primary Examiner*—Charles H. Nolan, Jr.

(57) ABSTRACT

A tray alignment calibration page and method and apparatus using the page are provided. The page has graduated scales along horizontal and vertical edges, such that the scale values are enterable into an interface to align an image to be printed centered on a target page.

1 Claim, 3 Drawing Sheets

PAPER TRAY ADJUSTMENT PAGE

BACKGROUND OF THE INVENTION

1. Technical Field

The invention relates to paper alignment for printing devices. More particularly, the invention relates to methods and apparatus for performing paper tray alignment using an alignment calibration page to determine and apply alignment calibration values.

2. Description of the Prior Art

When a new printer is configured, many features and pieces of equipment on the printer need to be set up and adjusted. Paper trays are no exception. For example, a technician could spend several minutes skewing and shifting the paper trays of a printer to ensure accurate registration, which is the precise positioning of printed elements. Ensuring accurate registration is important especially when printing duplex pages, i.e. both sides of pages.

The locations of elements to be printed on a page are typically described in Cartesian coordinates. When printing such elements on a page, the elements may end up with different coordinates than intended for the actual printed page, and sometimes such elements are printed smaller or larger than expected. Such problems arise, for example, when a medium (such as a page) feeding mechanism or drawing device is not precisely calibrated, or when the medium is stretched. Another problem is that sometimes impressions are skewed. Skewed impressions may happen, for instance, when paper trays, paper feeding mechanisms, and drawing devices are not parallel. Yet, another problem is that positions of printed elements are sometimes shifted, for example, towards the left, right, top, and/or bottom of a page.

Corrections to shifted elements are taught in Splash M Series, User's Manual Version 1.0, Sep. 22, 1998. A Splash M Series Configuration disk supports two page positioning configuration parameters in a DP.INI file: sshift and fshift. These parameters allow adjusting the position of an image with respect to the center of the page. The image can be repositioned in all four directions, up, down, right, and left. sshift adjusts the center of the page along an S axis (slow scan axis) and fshift adjusts the center of the page along an F axis (fast scan axis). The orientation of each of the S and F axes is dependent on the direction the paper is being pulled through the printer. The Splash technique is limited in correcting problems in shifting.

It would be advantageous to provide methods and apparatus to shift, rotate, and scale images to be printed on a page, thereby correcting for a paper tray's physical inadequacies.

It would be advantageous to provide methods and apparatus for paper tray adjustments that work with other devices, such as, for example, workstations and LCD panels, and with other applications.

It would be advantageous to provide methods and apparatus to calculate parameters for plane rotation and translation by using a test pattern, and whereby the use of any instrument for measuring is not required.

It would be advantageous to provide methods and apparatus to calculate a scaling factor parameter, and whereby only a ruler is needed.

SUMMARY OF THE INVENTION

A tray alignment calibration page and method and apparatus using the page are provided. The page is printable using an alignment dialog box. The page has graduated scales with values running along the horizontal and vertical edges. An end user folds the page in half horizontally and vertically to locate the center of the page. The end user also obtains other values, such as scaling factors, from the page. Such values are enterable as correction values into the alignment dialog to align an image to be printed on a target page so that printing occurs centered on the page. A set of input image Cartesian coordinates is mapped to output device Cartesian coordinates, taking into account scaling, rotational, and translation factors. The invention handles duplex printing, as well.

DETAILED DESCRIPTION OF THE INVENTION

Figure 1:
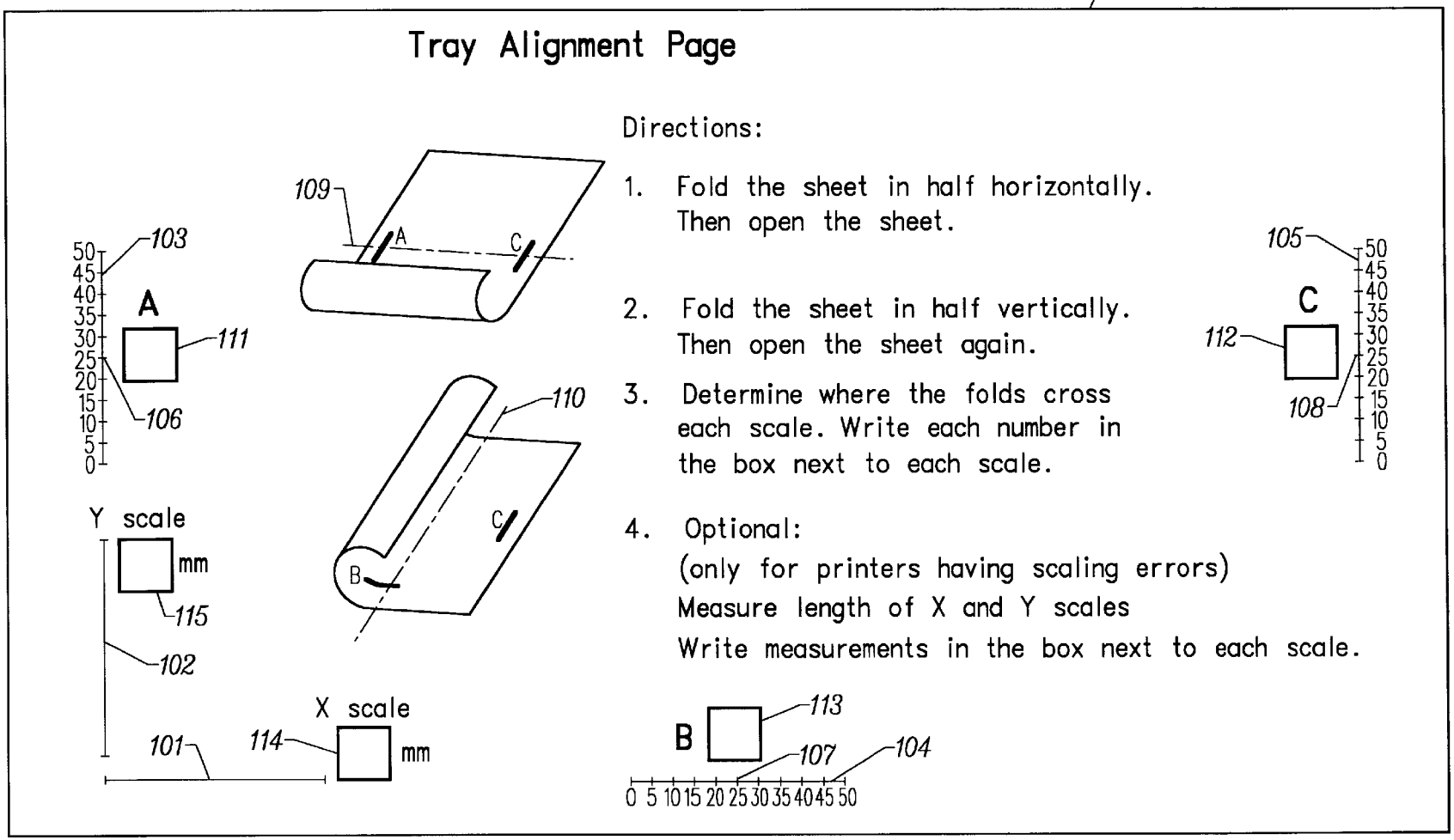
FIG. 1 is a schematic diagram showing a tray alignment calibration page, whereby alignment values can be obtained from scales according to the invention.

When a new printer is configured, many features and pieces of equipment of the printer need to be set up and adjusted. Paper trays are no exception. For example, a technician could spend several minutes skewing and shifting the paper trays of a printer to ensure accurate registration when printing duplex pages, where registration means the alignment of a page in a paper tray. The discussed invention shifts and rotates an image to be printed on a page to correct for the paper tray's physical inadequacies. The tray alignment technique discussed herein works seamlessly with workstations, LCD panels, and other applications.

A tray alignment calibration page and method and apparatus using the page are provided. The page is printable using an alignment dialog box. The page has graduated scales with values running along the horizontal and vertical edges. An end user folds the page in half horizontally and vertically to locate the center of the page. The end user also obtains other values, such as scaling factors, from the page. Such values are enterable as correction values into the alignment dialog to align an image to be printed on a target page so that printing occurs centered on the page. A set of input image Cartesian coordinates is mapped to output device Cartesian coordinates, taking into account scaling, rotational, and translation factors. The invention handles duplex printing, as well.

It should be appreciated that the discussed invention herein is not limited to printing devices, but relates to any outputting device involving outputting an image.

To print elements on a page, locations of such elements are usually supplied using Cartesian coordinates. For various reasons, these elements may end up at different coordinates on the actual printed page. The invention discussed herein measures the disparities in the coordinates and compensating for such differences.

The preferred embodiment of the invention refers to the plane of user-requested coordinates as a user plane, and the plane of printer-delivered coordinates as a device plane. The user plane represents a theoretical page as seen by, for example, a graphic designer; while the device plane represents an actual sheet as delivered by a printing device.

The preferred embodiment of the invention describes how to measure disparities and to compensate for differences between user and device planes. As an example of measuring such disparities and compensating for such differences between the user and device planes, the preferred embodiment of the invention uses scaling, rotational, and translation factors. The discussed invention interprets the disparities by measuring scaling, rotational, and translation parameters, and, thereby compensates for the differences by applying the measured parameters to scaling, rotational, and translation standard corrective functions or transforms.

Plane scaling can be used, for example when printed elements are smaller or larger than expected. This may happen, for instance, when the medium feeding mechanism or the drawing device is not precisely calibrated, or when the medium is stretched. Such disparities can be corrected by a transform using plane scaling.

Plane rotation can be used, for example, when impressions are skewed. This may happen, for instance, when paper trays, paper feeding mechanisms, or drawing devices are not parallel. Skew can be corrected by a transform using plane rotation.

Plane translation can be used, for example, when positions of printed elements are shifted towards the left or the right of a page, or towards the top or bottom of the page. Shifts in any possible combination of directions can be corrected by a transform using plane translation.

One targeted use for the preferred embodiment of the invention is electronically adjusting paper trays by filtering the size, angle, and location of page elements to ultimately locate such elements at an intended position by, for example, a designer, on the printed page. This technique is useful especially for two-sided (duplex) printing. By adjusting independently the source paper tray and the duplex paper tray (or duplex mechanism), images on both sides appear properly aligned.

The preferred embodiment of the invention provides the following procedure for using a test pattern to measure disparities and to compensate for the differences as discussed above:

Printing a test pattern on one side of a page;

Measuring the test pattern;

Calculating parameters for corrections, such as, for example, scaling factors, rotation angle, and translation values, and using the calculated parameters in compensation functions previously installed in the printing system. Such compensation functions transform incoming coordinates from a user plane into coordinates for a device plane; and Optionally, printing a verification page to confirm accuracy of the corrective adjustment.

It should be appreciated that the phrases test pattern and tray alignment calibration page are used interchangeably herein.

The preferred embodiment of the invention uses standard mathematical equations for coordinate systems substitutions or transforms. Such equations are available in many geometry books. One such reference is "CRC Standard Mathematical Tables and Formulae ($30^{th}$ edition)" 1996 CRC Press. The coordinate system substitution equations used in the preferred embodiment are described below.

When two planes have the same origin, equations for change of coordinates by plane scaling are (CRC, page 265):

$x'ax$ where $a \neq 0$ is the horizontal scaling factor.

$y'=by$ where $b \neq 0$ is the vertical scaling factor.

When a=b, scaling is proportional; when a=b=1, there is no need for compensation for plane scaling.

When two planes have the same origin, and the positive x' axis results from a counterclockwise rotation of the positive x axis by an angle θ, equations for change of coordinates by a rotation are (CRC, page 253):

$$x'=x \cos \theta - y \sin \theta$$

$$y'=x \sin \theta + y \cos \theta$$

When θ=0, there is no need for compensation for plane rotation.

When two planes have axes where x is parallel to x' and y is parallel to y', and the origin of the second plane coincides with the point $(x_0, y_0)$ of the first plane, equations for change of coordinates by plane translation are (CRC, page 253):

$$x'=x-x_0;$$

and $$y'=y-y_0.$$

When $x_0=y_0=x'_0=y'_0$, there is no need for compensation for plane translation.

These transforms can easily be combined into simple linear equations.

The preferred embodiment of the invention comprises determining and applying the parameters discussed above in a specific sequence of operations or transforms. The operations are called at the beginning of printing a new page to position images on the page where a designer wants them. As a practical example, the PostScript language offers the following operators, presented here in the order that they must be applied:

$t_x t_y$ translate;

θ rotate; and $s_x s_y$ scale.

The preferred embodiment of the invention comprises a tray alignment page, equally referred to as test pattern, and using the tray alignment page for gathering data to determine scaling, rotational, and translation factors for performing the corrective transformations or alignments of elements on a page.

The Tray Alignment Page

The preferred tray alignment page is described below and with reference to FIG. 1. FIG. 1 is a schematic diagram showing the preferred tray alignment calibration page, whereby alignment values can be obtained from scales, according to the invention.

It should be appreciated that when using tray alignment page 100, no measurement instrument is needed for calculating parameters for plane rotation and translation.

It should also be appreciated that when using tray alignment page 100, only a ruler is needed for calculating the scaling factor parameters.

The preferred embodiment of the invention has both user and device planes with origins in the lower left corner of the tray alignment page. X increases to the right and Y increases upwards. The dimensions of the tray alignment page are PageWidth wide by PageHeight high.

A scaling mark 101 is drawn parallel to horizontal edges of the page. The scaling mark 101 has length XscaleLength, written in box Xscale 114. A scaling mark 102 is drawn parallel to vertical edges of the page; its length is YscaleLength, written in box Yscale 115.

It should be appreciated that when a printer consistently delivers proportional scaling, only one scale measurement is required, and when a printer consistently delivers scaling factors of 100%, then no scaling marks are required.

The tray alignment page comprises graduated bars (BarA, BarB and BarC) (103, 104, 105, respectively) that are parallel to the page edges. For attaining accuracy, these bars are located as close as practical to the page edges. The distance between each bar and its closest edge is DistanceFromEdge. The distance between each graduation on a bar is DistanceBetweenTicks. The length of a bar is BarLength. Point A 106 is located at the center of BarA, Point B 107 is located at the center of BarB, and Point C 108 is located at the center of BarC.

Following are expected coordinates when every element is precisely located where specified in the user plane, as follows:

$x_A$=DistanceFromEdge $x_B$=(Page Width÷2) (middle of the page, horizontally)

$x_C$=(Page Width−DistanceFromEdge)

$y_A$=(PageHeight÷2) (middle of the page, vertically)

$y_B$=DistanceFromEdge $y_C$=(PageHeight÷2) (middle of the page, horizontally. Same as $y_A$)

Readings on horizontal bar B 104 are converted into user plane coordinate x by the following equation:

$$x=F_x(\text{Reading}_B),$$

where $$F_x(\text{Reading}_B)=x_B-(\text{ScaleLength}\div 2)+(\text{Reading}_B\times\text{DistanceBetweenTicks}).$$

Similarly, readings on vertical bars A 103 and C 105 are converted into user plane coordinate y with the following equations:

$$y=F_y(\text{Reading}),$$

where $$F_y(\text{Reading}_A)=y_A-(\text{ScaleLength}\div 2)+(\text{Reading}_A\times\text{DistanceBetweenTicks}),$$

and $$F_y(\text{Reading}_C)=y_C-(\text{ScaleLength}\div 2)+(\text{Reading}_C\times\text{DistanceBetweenTicks}).$$

The preferred embodiment of the invention calculates the following factors in the order shown below:

Plane scaling factors ($s_x s_y$);

Plane rotation angle ($\theta$);

and

Plane translation values ($t_x t_y$)

That is, an end user evaluates scaling factors first. If the horizontal scaling mark is expected to measure XscaleLength but actually measures XscaleLength' on the printed page, then the desired horizontal scaling factor is:

$$s_x=\text{XscaleLength}\div\text{XscaleLength}'.$$

Similarly, if the vertical scaling mark is expected to measure YscaleLength but actually measures YscaleLength' on the printed page, the desired vertical scaling factor is:

$$s_y=\text{YscaleLength}\div\text{YscaleLength}'.$$

It should be appreciated that every measurement on the printed tray alignment page integrates these scaling factors above. Therefore, herein this document, scaling factors of 1.0 (no scaling required) is assumed to simplify equations.

To calculate the plane rotation angle, the end user folds the tray alignment sheet horizontally in half to produce a fold line 109 passing by the vertical center of the actual sheet. This horizontal fold line 109 crosses the vertical scales A 103 and C 105 at UserReadingA, written in box A 111 and UserReadingC, written in box C 112. Using equations presented earlier, points UserReadingA and UserReadingC have the following y coordinates in user plane:

$$y_{userReadingA}=F_y(\text{UserReadingA})$$

$$y_{userReadingC}=F_y(\text{UserReadingC})$$

Due to translation and rotation transforms, UserReadingA and UserReadingC points end up at the vertical center of the actual page (the device plane). When there is no error due to plane rotation, then $y_{UserReadingA}=y_{UserReadingC}$. In other words: the difference between $y_{UserReadingA}$ and $y_{UserReadingC}$ is due to plane rotation.

The angle for plane rotation is evaluated by figuring a right triangle from points UserReadingA, UserReadingC and a line drawn perpendicularly from BarA 103 to BarC 105. Three values are required to solve a triangle. They are:

$$\text{DistanceAC}=x_c-x_a$$

$$\text{DeltaY}=y_{UserReadingA}-y_{UserReadingC}$$

90° (right angle between the vertical graduated bars and the virtual line from point A to C).

Following is the equation to evaluate the amount of rotation to be applied between planes:

$$\theta=-\tan^{-1}(\text{DeltaY}\div\text{DistanceAC})$$

To calculate plane translation values, the end user folds the tray alignment sheet vertically in half to produce a fold line 110 passing by the vertical center of the actual sheet. This vertical fold line 110 crosses the horizontal scale B 104 at UserReadingB, written in box B 113. Using the equations for plane rotation presented earlier, and the rotation angle $\theta$ just measured, the x coordinate of UserReadingB and the y coordinate of UserReadingC in the rotated plane before translation can be evaluated by:

$$x'_{UserReadingB}=x_{UserReadingB}\cos\theta-y_B\sin\theta$$

$$y'_{UserReadingC}=x_C\sin\theta+y_{UserReadingC}\cos\theta$$

Using equations for plane translation presented earlier, with $x'_{UserReadingB}$ and $y'_{UserReadingC}$ just calculated, it is possible to evaluate how much translation needs to be applied between planes:

$$t_x=x'_{UserReadingB}-x_B$$

$$t_y=y'_{UserReadingC}-y_C$$

It should be appreciated that the discussion above can be generalized not to use an end user, but can be performed more broadly, such as be automated, for example.

It should also be appreciated that the discussed invention aligns every page that prints through the printing device. That is, there is no need to print documents through a special application or program. For example, a file printed from MS Word can have the discussed tray alignment performed on it.

An operator doesn't need to use any type of measuring device to align a tray because the tray alignment sheet is folded in half and the ruler is obsolete because the center of the sheet is known.

The exact center of a page is determined through measurements taken on the outskirts of the sheet in the following manner. Each point on an imaginary line across the sheet is known and a remaining point on an adjacent edge of the sheet connects to an imaginary point at a right angle, the exact center of the sheet is known.

If every image is printed to this exact center, the issue of alignment known in the art as "Top-Top" and "Top-Bottom" duplexing is eliminated. Both versions of duplexing print to the center of the sheet, thereby eliminating the need to fumble with rotation of the print of origin.

Tray Alignment Usage

Figure 2:
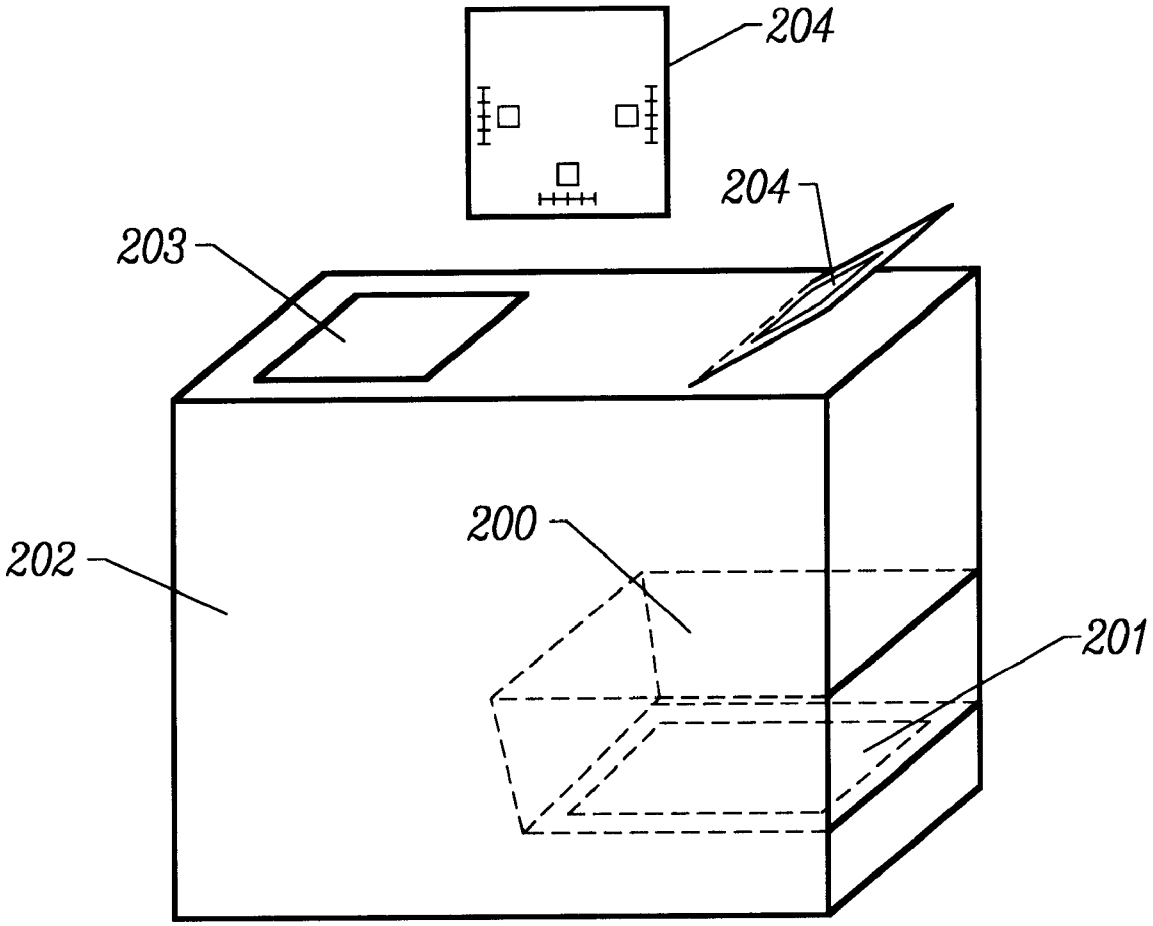
FIG. 2 is a block diagram of an apparatus for performing tray alignment for at least one tray associated with a media size and associated with an output device to correct for outputting inadequacies in the output device system according to the invention.

The preferred embodiment of the invention provides an apparatus for performing tray alignment to correct for outputting inadequacies in an output device, and is described with reference to FIG. 2. FIG. 2 is a block diagram of an example of an apparatus for performing tray alignment for at least one paper feeding mechanism 200 associated with a media type 201 and associated with an output device 202. An end user uses an input means 203, such as, for example, an LCD panel, to specify which tray is to be aligned and which media-type to use. FIG. 2 shows one tray 200 to be aligned and one media-type 201 within the tray. In this example, through input means 203, media-type 201 and specific tray 200 are specified in outputting an tray alignment calibration page 204. The alignment calibration page 204 comprises markings that are used to determine alignment calibration values. The preferred tray alignment calibration page is discussed above. Measured calibration parameters are entered into input means 203, whereby calibration values are determined and are subsequently applied to outputs.

The preferred embodiment of the invention provides the following technique for performing tray alignment on an output device:

- Specifying a tray to be aligned, taking into account whether or not a duplexing unit is attached to the device;
- Printing a tray alignment calibration page. If a duplexing unit is attached, the alignment calibration page is optionally double-sided;
- Determining alignment calibration values using the alignment calibration page and entering such values in a tray alignment dialog; and
- Applying the calibration values, and printing a test page to show that the alignment calibration worked properly.

The following should be appreciated about the preferred embodiment of the invention. Applied alignment calibration values replace any existing alignment calibration values. Alignment calibration values are stored as each tray is calibrated. When a previously calibrated page size is used on a tray, it is not required to apply the calibration. Previously set alignment calibration values are ignored when printing the alignment calibration page.

The preferred embodiment of the invention stores the following data to ensure that tray alignment is performed properly:

- Alignment calibration values are stored whenever an alignment calibration is performed;
- Unique calibration values are stored for each tray-media size;
- Tray-media type combinations that have not been calibrated are set to initial values; and
- Data stored for each tray includes:
  - Top side calibration values;
  - Bottom side, or duplex calibration values; and
  - Date of last alignment calibration, where if calibration has not been performed, then the date and time have default values.

Tray Alignment User Interface

The preferred embodiment provides a user interface for performing tray alignment. Tray alignment can be performed using various input mechanisms, such as, but not limited to, a workstation, a LCD panel, and a custom print driver interface.

As an example of an input mechanism for a workstation in the preferred embodiment of the invention, an end user can open a tray alignment dialog box through a menu option, such as, for example, a Server->Tray Alignment menu option. Such option opens a tray alignment dialog box.

Figure 3:
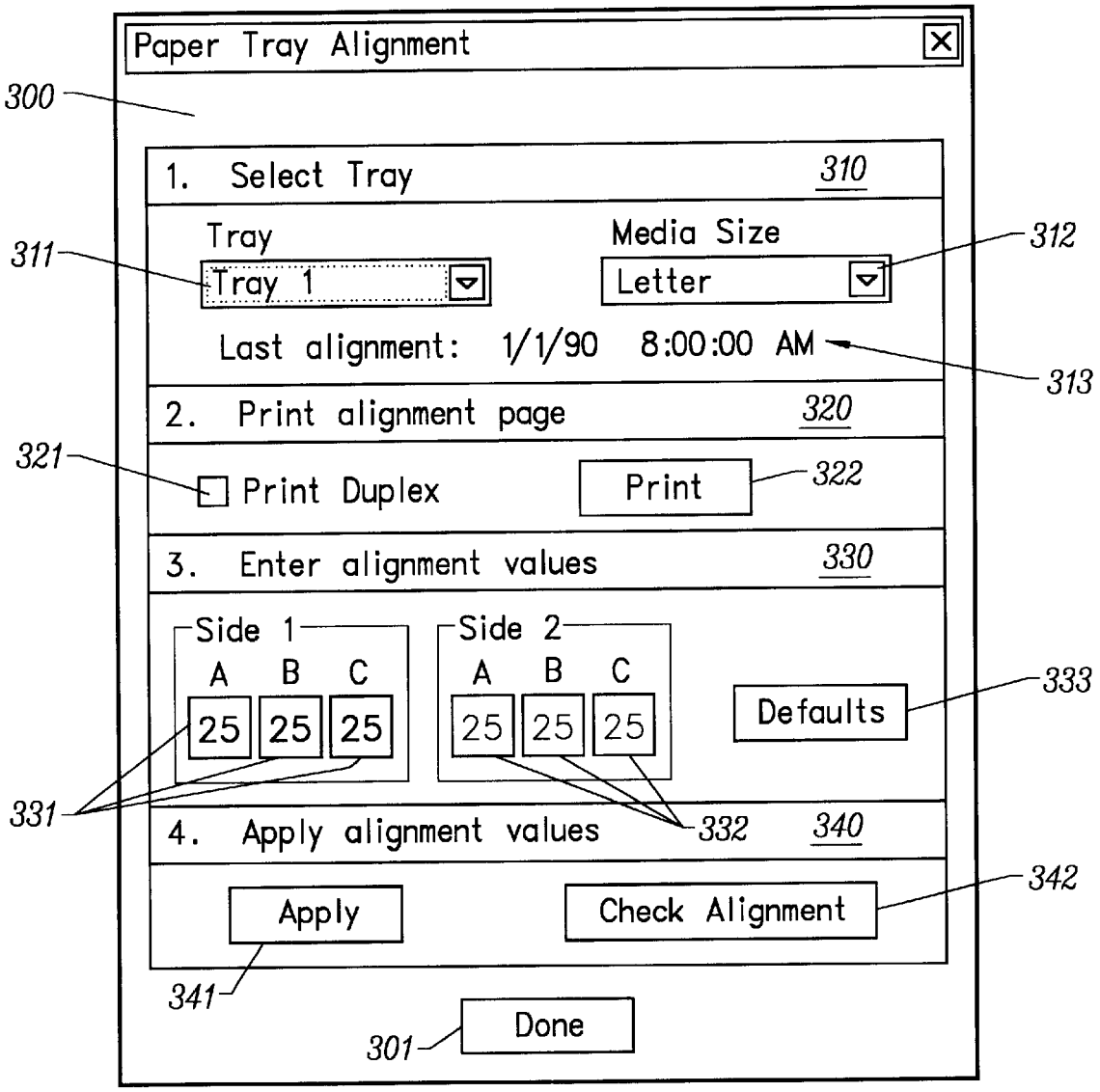
FIG. 3 is a screen print of an example of a tray alignment dialog box for duplex printing according to the invention.

For an example of a tray alignment dialog box, refer to FIG. 3. FIG. 3 is a screen print of an example of a tray alignment dialog box for duplex printing. The tray alignment dialog 300 separates tray alignment action for a single paper tray into a series of four steps described below.

It should be appreciated that when such tray alignment dialog box opens, previous alignment calibration values are automatically displayed under an Enter alignment values section 310.

Step 1—Select Tray

An end user selects a paper tray to be calibrated and a media size. Trays in pull-down list 311 are dependent upon the corresponding output device. The media sizes available 312 are also dependent upon the output device.

The date and time of the last tray alignment calibration 313 is also shown under Select Tray 310. At initial alignment, the date and time shown are default values.

Step 2—Print Alignment Page

The end user chooses to print an alignment calibration page 320. If the output device is enabled for duplex printing, a checkbox is available for Print Duplex 321.

If the output device is non-duplex, then the end user selects Print button 322. A single-sided tray alignment calibration page is printed to the tray selected under Select Tray 310.

If the output device is duplex, then the end user sets the duplex checkbox 321 to choose a single-sided or double-sided alignment calibration page, and then selects the Print button 322. A single-sided or double-sided alignment calibration page depending on checkbox 321 status is printed using a sheet from the tray selected under Select Tray 310.

Step 3—Enter Alignment Values

The end user obtains and subsequently enters calibration alignment values that the workstation uses to determine how much the image needs to be shifted and rotated on the page to print properly.

Following is a preferred way for the end user to obtain tray alignment values:

Retrieving printed tray alignment calibration page;

Carefully folding page in half vertically and in half horizontally, determining where folds fall on the graphs on page; and transcribing values taken from scales into corresponding input boxes next to each scale;

Repeating preceding operation for duplex option, if applicable; and

Transferring values written on calibration page to text boxes A, B, and C 331 under Enter alignment values section 330. If the Print Duplex checkbox 321 is enabled from the Print Alignment Page section 320, then also entering duplex values under the Side 2 section 332 of the Enter alignment values section 330.

It should be appreciated that selecting the Defaults Button 333 causes alignment values to be set to default, or initial values. In the preferred embodiment, the default value is the midpoint of the scale and in the example is equal to 25. When the Defaults Button 333 is selected, a Yes/No dialog appears asking the end user "Do you wish set the default tray alignment values for the current tray, or for all trays? Setting the default values for all trays will cause all currently stored tray alignment calibration values to be replaced."

Step 4—Apply

Once all alignment calibration values have been correctly entered under Enter Alignment Values (330, 331), the end user selects an Apply button 341 from the Apply alignment values section 340.

At this point, newly entered alignment calibration values replace any previously existing alignment calibration values.

Clicking the Check Alignment button 342 causes a test page to be printed using the input calibration values.

It should be appreciated that in this example, if the Apply button 341 is clicked, then clicking the Check Alignment button 342 causes the calibration values to be applied automatically.

The end user selects the Done button 301 to close the Tray Alignment dialog box and end the procedure.

Another equally preferred embodiment on the invention allows uses LCD panels. As an example, an end user opens a LCD functions menu and selects a Tray Alignment menu. The Tray Alignment menu has three options: Exit Tray Alignment, Align Trays, and Restore Defaults as described below.

The Exit Tray Alignment option exits the tray alignment LCD menu and returns to an LCD functions menu.

The Align Trays option provides the following:

At a Align Tray LCD screen the end user selects a tray number using select buttons, then selects OK;

At a Paper Size LCD screen the end user selects a media size, then selects OK;

If duplexing is installed the Align Tray for Duplex Printing LCD screen is shown. The end user selects Yes to run tray alignment calibration for duplex, then selects OK. Selecting No returns the end user to the Tray Alignment LCD menu;

At a Print Alignment Page option the end user selects Yes to print the tray alignment calibration page. The alignment calibration page prints uses the tray selected at the Align Tray LCD screen;

Next, the end user enters alignment values for side one of the page under Side 1: Alignment Value A (B.& C, respectively) LCD screens;

If an alignment calibration page for duplex is printed, then the end user enters calibration values under Side 2: Alignment Value A (B & C, respectively) LCD screens;

At an Apply Alignment Values LCD screen the end user selects Yes to apply the alignment calibration values to the selected tray. Selecting No returns the end user to the Tray Alignment LCD menu without applying alignment calibration values; and At a Check Alignment LCD screen the end user selects Yes to print a test page to demonstrate that the alignment calibration was successful, and selects OK to return to the LCD Functions menu.

The Restore Defaults option restores the default tray alignment calibration values as described below:

At a Select Tray LCD screen the end user selects a tray number using select buttons, then selects OK; and At a Restore Defaults for Tray Name LCD screen the end user selects Yes to restore default values, and then selects OK to return to the LCD Functions menu.

An equally preferred embodiment of the invention uses a custom print driver interface, also referred to interchangeably herein as a unidriver. For example, a unidriver interface can provide a paper source header under which an Enable Tray Alignment checkbox is provided.

It should be appreciated that additional features as well as suggested enhancements can be added to the invention claimed herein without deviating from the scope and spirit of the invention. Two such examples are duplex autosensing for two-sided calibration, and applying required changes independently from a printer's programming language.

Accordingly, although the invention has been described in detail with reference to particular preferred embodiments, persons possessing ordinary skill in the art to which this invention pertains will appreciate that various modifications and enhancements may be made without departing from the spirit and scope of the claims that follow.

What is claimed is:

1. A method for performing paper tray alignment in a printing device, the method comprising:

printing a test pattern on a first side of a page, the test pattern comprising a first graduated bar that is parallel to a first edge of the page, a second graduated bar that is parallel to a second edge of the page, and a third graduated bar that is parallel to a third edge of the page;

folding the page in half to produce a first fold line at the center of the first edge of the page;

reopening the page;

folding the page in half to produce a second fold line at the center of the second and third edges of the page;

reopening the page;

determining a first location where the first fold line crosses the first graduated bar, a second location where the second fold line crosses the second graduated bar, and a third location where the second fold line crosses the third graduated bar;

calculating a plane rotation angle based on the second and third locations; and calculating a plane translation value based on the plane rotation angle and the first and third locations.

* * * * *